United States Patent [19]

Wynn

[11] Patent Number: 4,981,232

[45] Date of Patent: Jan. 1, 1991

[54] LAUNDRY BASKET

[76] Inventor: Paul M. Wynn, 1152 Gorsline Dr., El Cajon, Calif. 92104

[21] Appl. No.: 480,956

[22] Filed: Feb. 16, 1990

[51] Int. Cl.[5] ..... B65D 6/00

[52] U.S. Cl. ..... 220/22.3; 220/23.83; 206/562; 206/561

[58] Field of Search ..... 220/20, 22.3, 23.83, 220/23.86, 47; 206/562, 561

[56] References Cited

U.S. PATENT DOCUMENTS

| | | | |
|---|---|---|---|
| 2,020,373 | 11/1935 | Petzolo Jr. | 220/22.3 |
| 2,081,078 | 5/1937 | Watson | 220/22.3 |
| 2,989,190 | 6/1961 | Auzicky | 220/22.3 |
| 3,067,903 | 12/1962 | Jones Jr. | 220/22.3 |
| 4,372,444 | 2/1983 | Le Grand et al. | 220/22.3 |
| 4,776,477 | 10/1988 | Walker | 220/22.3 |

*Primary Examiner*—Joseph Man-Fu Moy
*Attorney, Agent, or Firm*—Charles C. Logan, II.

[57] ABSTRACT

An improved laundry basket having a detachable divider wall that divides the laundry basket into a clothes compartment and a clothes washing products compartment. A top wall panel extends laterally from the top edge of the divider wall toward the closest side wall so that it spans the clothes washing products compartment. A lip on the outer edge of the top wall panel mates with the lip of the respective side wall. An aperture is formed in the top wall panel and it detachably receives a cup having an outwardly extending annular flange at its top edge. Raised indicia structure on the outer surface of the cup provides markings for measuring contents in the cup. With the divider panel removed, a plurality of laundry baskets may be stacked in a nested fashion.

10 Claims, 1 Drawing Sheet

LAUNDRY BASKET

BACKGROUND OF THE INVENTION

The invention relates to a basket and more specifically to a basket that is used for carrying dirty laundry, clothes washing products, and coins for commercial washing and drying machines.

Presently a large percentage of our population lives in apartments and rental housing and do not have their own washing machines and clothes dryers. These people periodically take a load of dirty laundry to the commercial laundry for self washing. In doing so they stack their laundry baskets full of dirty laundry, pile their boxes of detergent, fabric softener, bleach, etc. on top of the load and then struggle with a hand full of change. More often than desired, the person carrying the mountain of laundry and boxes manages to drop one or more items and while attempting to pick them up additional items manage to fall.

It is an object of the invention to provide a novel improved laundry basket that provides a separate compartment for dirty laundry and washing products.

It is also an object of the invention to provide a novel improved laundry basket that has a quick release structure on the edges of a divider panel that allows it to be easily attached and detached from the basic laundry basket structure.

It is another object of the invention to provide a novel improved laundry basket that has structure for holding coins to be used in coin operated washing and drying machines.

It is a further object of the invention to provide an improved novel laundry basket that is economical to manufacture and market.

It is an additional object of the invention to provide a novel improved laundry basket that has a measuring cup detachably mounted in its structure.

SUMMARY OF THE INVENTION

Applicant's novel improved laundry basket has been designed to solve many problems presently experienced by people who use commercial coin operated laundry facilites when washing their clothes. The basic structure of the laundry basket is preferrably rectangular in shape and several of its side walls are formed of a lattice-like structure by intersecting vertical and horizontal strips of plastic material. The top edges of the front, rear, and side walls have an outwardly and downwardly extending lip. A divider panel has fastening structure on its bottom edge and side edges that mate with structure on the respective front and rear walls and bottom wall of the basket and provide a quick release structure.

The divider panel divides the interior of the laundry basket into a clothes compartment and a clothes washing products compartment. Some items that might be stored in the clothes washing products compartment are detergents, fabric softeners, bleach, etc. The divider panel is formed of a planar sheet of material and the other surrounding walls of the clothes washing products compartment are preferrably formed with a solid sheet of material. Alternatively, these walls could also have a lattice-like structure and still perform their intended function.

A top wall panel extends laterally from the top edge of the divider panel and it has a downwardly extending lip on its outer end that mates with its respective lip on the side wall of the basket. An aperture is formed in the central area of the top wall panel and it detachably receives a cup having an outwardly extending annular flange at its top edge. This cup has a dual purpose. It can be used to carry coins when carrying the dirty laundry to the coin operated laundry machines. It can also be used as a measuring cup for the different cleaning products.

DESCRIPTION OF THE PREFERRED EMBODIMENT

Figure 1:
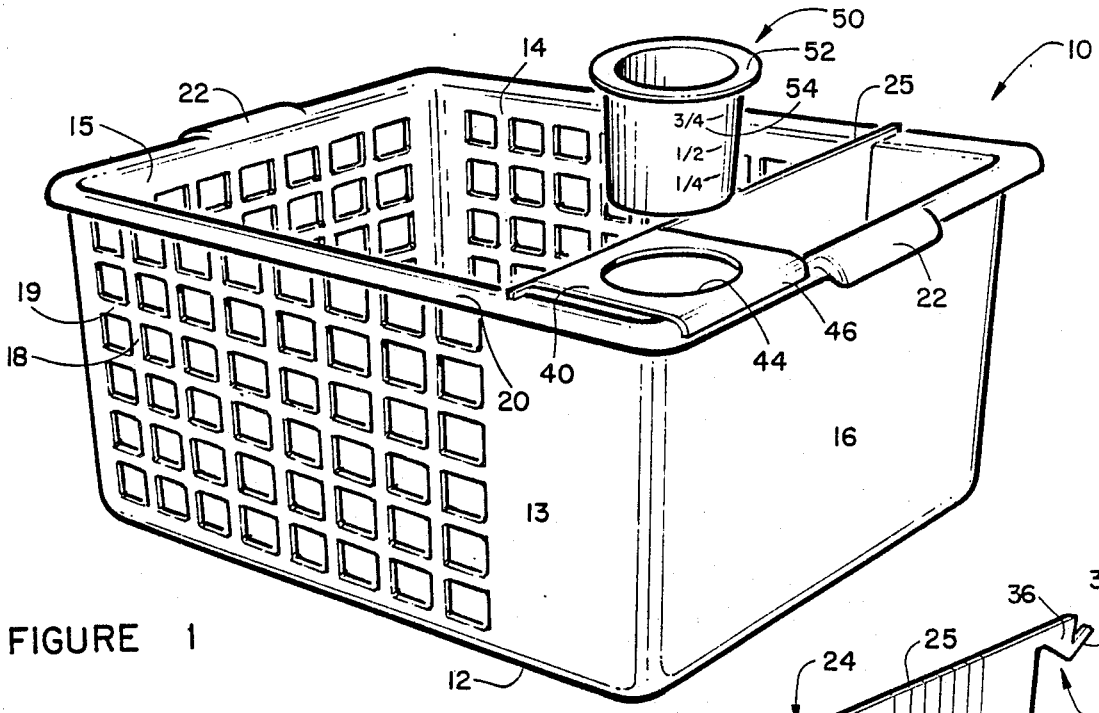
FIG. 1 is a front perspective view of applicant's novel laundry basket.
Figure 3:
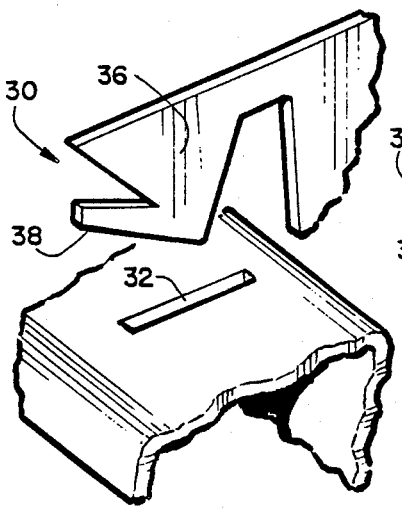
FIG. 3 is a partial top plan view of the laundry basket showing how the divider panel is detachably secured thereto.
Figure 2:
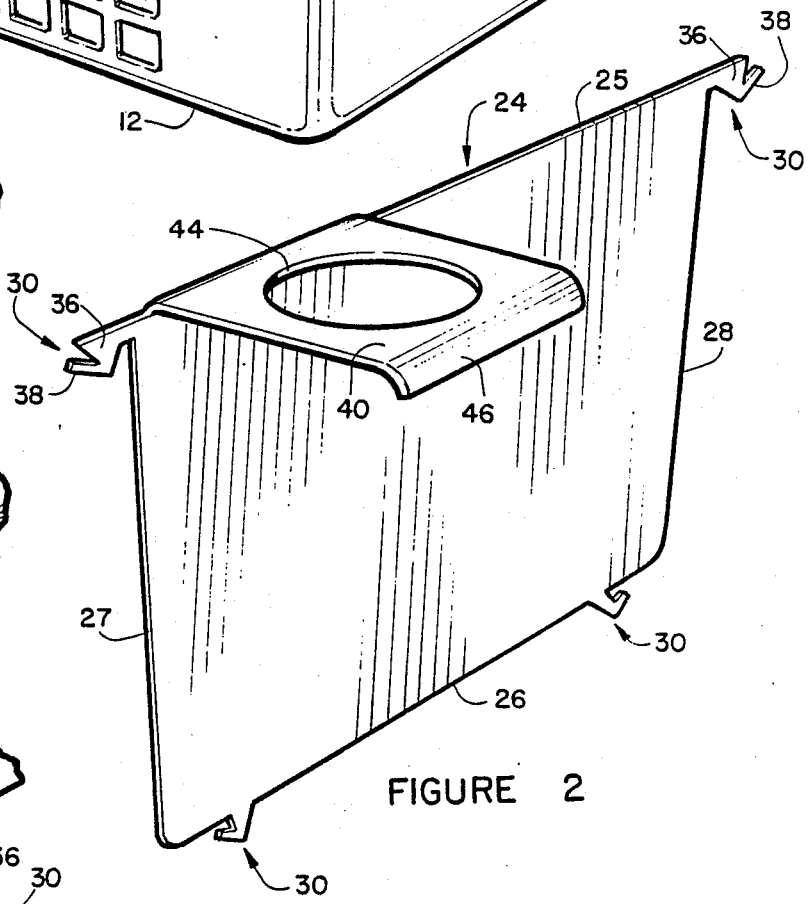
FIG. 2 is a front perspective view of the divider panel by itself and also showing the measuring cup.

Applicant's novel laundry basket will now be described by referring to FIGS. 1–4 of the drawing. The laundry basket is generally designated numeral 10.

Laundry basket 10 has a bottom wall 12, a front wall 13, a rear wall 14, and laterally spaced side walls 15 and 16. Some of the walls have a lattice-like wall structure formed by intersecting vertical strips 18 and horizontal strips 19. An outwardly and downwardly extending lip 20 extends around the entire perimeter of the top edge of the basket. Handles 22 are formed on the lip 20 at the respective opposite side walls.

Figure 4:
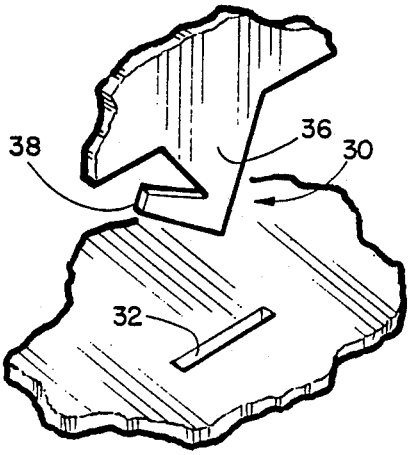
FIG. 4 is a partial perspective view showing the quick release type fastener structure of the divider panel and its mating structure in the basket.

A divider panel 24 has a top edge 25, bottom edge 26, and laterally spaced side edges 27 and 28. Quick release fastener structure 30 or dogs are formed adjacent the respective edges of panel 24. This structure is detachably secured in slots 32 in the bottom and front and rear walls of basket 10. Closer detail of the structure is illustrated in FIG. 4. Fastener structure 30 is seen to have triangularly-shaped protrusion 36 along with a leg portion 38. When this structure is inserted into slot 32 leg portion 38 functions to restrict it from being easily pulled therefrom.

A top wall panel 40 extends laterally from the top edge 25 of divider panel 24. An aperture 44 is formed therein having a diameter D1. Top wall panel 40 has a width W1. An outwardly and downwardly extending lip 46 is formed adjacent its front edge.

A cup 50 has an outwardly extending annular flange 52 adjacent its top end. It has a diameter D1 adjacent its top edge. Raised indicia measuring markings are formed on the outer surface of cup 50.

What is claimed is:

1. A laundry basket comprising:

an elongated bottom wall having a predetermined length L1, said bottom wall having a front edge, a rear edge and laterally spaced side edges;

a front wall, a rear wall and laterally spaced side walls that are upright oriented and they each have top edges and bottom edges, said bottom edges connected to the respective front, rear and side edges of said bottom wall to form an open top laundry basket;

the top edges of said front wall, rear wall and laterally spaced side walls have an outwardly and downwardly extending lip that forms a complete loop around the top of said clothes basket;

a divider wall having a front edge, a bottom edge and laterally spaced side edges;

quick-release means for fastening said divider wall to the interior of said laundry basket to divide it into a clothes compartment and a clothes washing products compartment; and a top wall panel extending laterally from the top edge of said divider panel toward the closest side wall and it has an outwardly and downwardly extending lip that mates with the lip on the top edge of said side wall.

2. A laundry basket as recited in claim 1 wherein said top wall panel has an aperture in it for receiving and supporting a cup.

3. A laundry basket as recited in claim 2 further comprising a cup having a top edge with an outwardly extending annular flange and said cup is detachably received in the aperture in said top wall panel.

4. A laundry basket as recited in claim 3 wherein the outer surface of said cup has a plurality of raised indicia structure on it that functions as measuring marks for said cup.

5. A laundry basket as recited in claim 1 further comprising a handle formed on each of the side walls that extend outwardly from said lip.

6. A laundry basket as recited in claim 1 wherein one of the side walls and the portion of the front and rear walls between said side wall and divider panel have a lattice-like structure formed by intersecting vertical and horizontal strips.

7. A laundry basket as recited in claim 1 wherein said divider panel is made of a planar sheet of material.

8. A laundry basket as recited in claim 1 wherein said laundry basket is integrally formed of plastic material.

9. A laundry basket as recited in claim 1 wherein said laundry basket has a rectangular shape.

10. A laundry basket as recited in claim 1 wherein said front wall, rear wall and side walls extend upwardly at an acute angle so that a plurality of said laundry baskets can be stacked for storage or display.

* * * * *